United States Patent [19]

Gladden

[11] 4,143,863

[45] Mar. 13, 1979

[54] LIFT TOP QUENCH HARDENING PRESS

[75] Inventor: Kenneth D. Gladden, East Peoria, Ill.

[73] Assignee: Caterpillar Tractor Co., Peoria, Ill.

[21] Appl. No.: 830,544

[22] Filed: Sep. 6, 1977

[51] Int. Cl.[2] ..... C21D 9/32

[52] U.S. Cl. ..... 266/118

[58] Field of Search ..... 266/117, 118, 119

[56] References Cited

U.S. PATENT DOCUMENTS

| | | | |
|---|---|---|---|
| 77,396 | 4/1868 | Mercer et al. | 266/117 |
| 1,772,576 | 8/1930 | Slade | 266/118 |

FOREIGN PATENT DOCUMENTS

| | | | |
|---|---|---|---|
| 50-10523 | 4/1975 | Japan | 266/117 |
| 401737 | 5/1974 | U.S.S.R. | 266/118 |

*Primary Examiner*—Roy Lake
*Assistant Examiner*—Paul A. Bell
*Attorney, Agent, or Firm*—Phillips, Moore, Weissenberger, Lempio & Majestic

[57] ABSTRACT

A die quench press for hardening gears and other generally circular parts is disclosed. The press has a horizontal die which generally comprises a plurality of segments movable radially inwardly and outwardly. The upper die portion of the press rotates into a vertical position for easy insertion of parts to be quenched.

13 Claims, 7 Drawing Figures

78
10
102
78
86
82
80
12

FIG_6
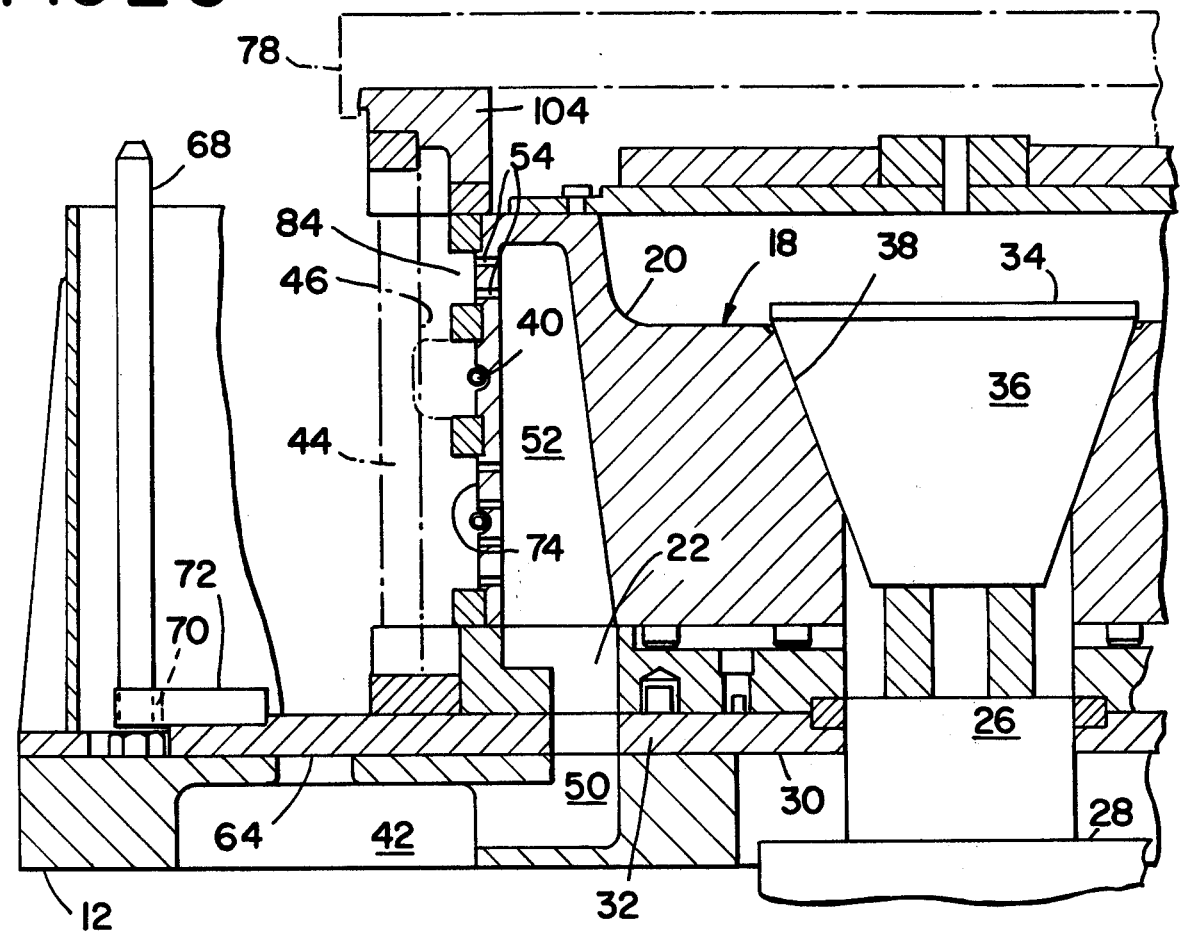
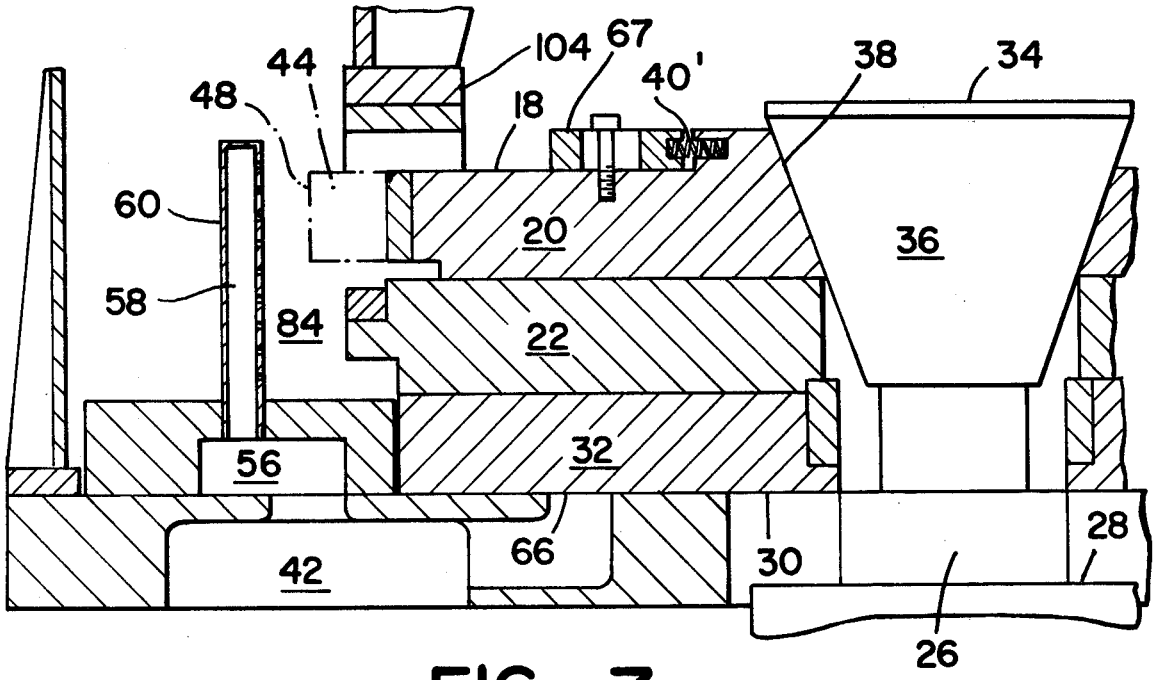
FIG_7

LIFT TOP QUENCH HARDENING PRESS

BACKGROUND OF THE INVENTION

1. Field of the Invention

The invention relates to die quench presses and more particularly to die quench presses for hardening gears and other large generally circular parts.

2. Prior Art

In prior art quench presses, the upper dies or platens have been capable of movement in only the vertical direction. In such designs the upper platen has contained an expander cylinder for motivating a plurality of segments radially inwardly and outwardly to contact the part which is to be quenched. With these prior art quench presses it is necessary to load the parts being processed in between the upper and lower die platens either directly or by a conveyor table built into the press. Thus in the prior art designs the lower die holder must be made either swingable or slidable when the press is to be used for large heavy parts. This has created a problem since the lower die holder must have a precise location if precision quenching results are to be obtained. Yet, the swinging or sliding of the lower die holder can easily lead to an inconsistent location of the parts to be quenched. A still further disadvantage of the prior art designs is that the expander cylinder and segmented expander die has been carried by the upper platen. When large gears or other generally circular parts are to be quenched in such a machine, it is difficult to install the heavy expander cone and cylinder in view of their large size and weight. Further, the prior art design is inherently tall and requires considerable overhead clearance, especially when large parts are to be quenched therein. It is clear that the height of the press can be a hindrance by requiring the use of high ceiling rooms. Also, any related overhead crane equipment must be designed to avoid interfering with the space into which the press proceeds upwardly.

SUMMARY OF THE INVENTION

The present invention is directed to overcoming one or more of the problems as set forth above.

According to the present invention there is provided a lift top quench hardening press. The press comprises a frame supporting a lower die, a horizontal die and an upper die, the upper die being pivotally attached to the frame. Means are provided for pivoting the upper die between a generally horizontal position adjacent the lower die and defining a quench zone therewith and a generally vertical position transversly spaced from said quench zone. Means are provided for delivering fluid to the quench zone.

BRIEF DESCRIPTION OF THE DRAWINGS

The invention will be better understood by reference to the figures of the drawings wherein like numbers denote like parts throughout and wherein:

FIG. 6 illustrates, in partial side section, a press in accordance with the present invention arranged for quench hardening an inner annular surface of a workpiece; and FIG. 7 illustrates, in partial side section, a press in accordance with the present invention arranged for quenching an annular outer surface of a workpiece.

DETAILED DESCRIPTION OF THE PREFERRED EMBODIMENT

Figure 1:
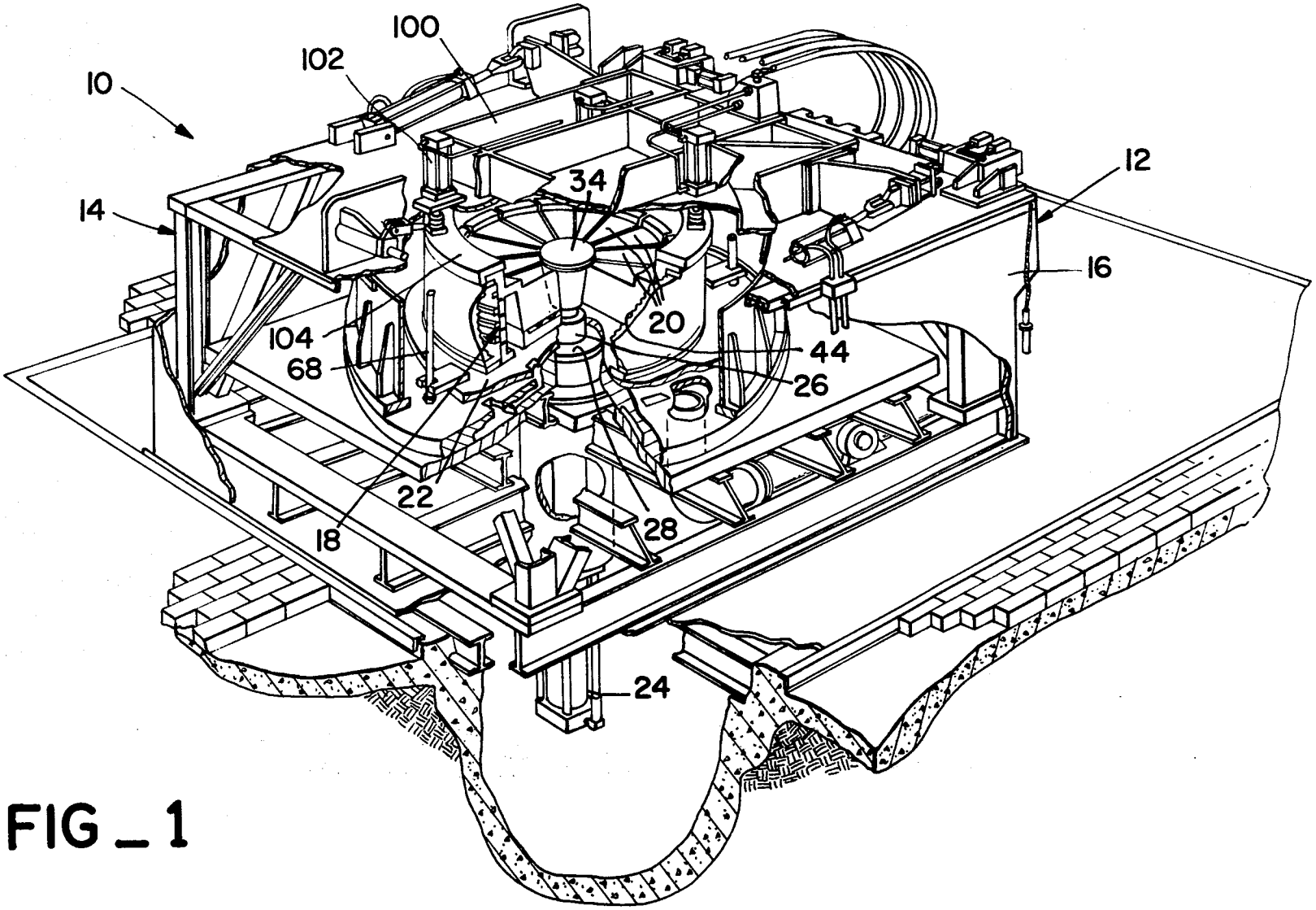
FIG. 1 illustrates, in perspective, a press in accordance with the present invention.

Adverting first to FIG. 1, there is illustrated therein a lift top quench hardening press 10 in accordance with the present invention. The press 10 includes a lower die 12 formed of a frame 14 covered by walls 16.

The press 10 as will be most readily apparent by reference to FIGS. 1, 6 and 7 includes a lower generally horizontal die 18 in generally circular form and comprising a plurality of segments 20. Means are provided on the housing for supporting the horizontal die 18. In the embodiments illustrated, the support means comprises a flat horizontal support plate or lower die 22.

Means are provided for lifting the horizontal die 18 with the support plate 22. In the embodiment illustrated this means comprises a hydraulic motor 24 having a rod 26 with a shoulder 28 extending outwardly therefrom so as to contact a bottom face 30 of a resting plate 32 upon which the flat support plate 22 and the segments 20 are raised upwardly. The hydraulic motor 24 also serves a second purpose. A top end 34 of the rod 26 is formed into an inverted truncated cone 36. Each of the segments 20 has an angled edge 38 which matches the angle of the cone 36 and which sits against the cone 36. As the cone 36 is moved downwardly under the impetus of the hydraulic motor 24, the various segments 20 are forced outwardly. As the cone 36 moves upwardly under the impetus of the hydraulic motor 24, the segments 20 move inwardly under the impetus of circular spring means 40. Thus the combination of the circular spring means 40 and the cone 36 of the rod 26 serve to provide means for expanding and contracting the horizontal die 18.

The lower die 12 includes annular manifold means, in the embodiment illustrated an annular manifold 42 for delivering a quench liquid to a workpiece 44 in a quench zone 84. In the embodiments illustrated in FIGS. 6 and 7, the quench liquid is delivered simultaneously to an inner annular surface 46 as illustrated in FIGS. 1 and 6 or an outer annular surface 48 as illustrated in FIG. 7.

Referring particularly to FIG. 6, there is illustrated an embodiment of the invention wherein the quench liquid is delivered to an inner annular surface 46 of the workpiece 44. In this embodiment, the quench fluid passes from the annular manifold 42 via a conduit 50 through a passage 52, one of which is within each of the segments 20. From the passage 52 the quench fluid flows via a plurality of out-facing fluid delivery holes 54 aimed toward the inner annular surface 46 and serve for delivery of the quench liquid thereto.

Referring now to FIG. 7, there is illustrated an embodiment wherein the quench liquid is delivered to the outer annular surface 48 of the workpiece 44. In this embodiment, the quench liquid passes from the annular manifold 42 via a conduit 56 and into a duct 58 formed within an annular wall 60 which is coaxial with and surrounds the segments 20. From the duct 58 the quench fluid flows via a plurality of in-facing fluid delivery holes 62 which aim toward the outer annular surface 48 of the workpiece 44 and serve for delivery of the quench liquid thereto. When quenching is desired of the inner annular surface 46 of the workpiece 44, the conduit 56 is blocked by a portion 64 of the resting plate 32. When it is desired to apply the quench liquid to the outer annular surface of the workpiece 44, the conduit 50 is blocked by a second portion 66 of the resting plate 32. It will be noted by reference to FIGS. 6 and 7 that different resting plates 32 may be utilized along with different flat support plates 22, dependent upon the size of the workpiece 44. It is further clear then that the first portion 64 of the resting plate 32 serves as means for blocking off fluid flow between manifold and the annular duct of the annular wall 60. In the same manner the second portion 66 of the resting plate 32 serve as means for blocking off fluid communication between the annular manifold 42 and the segment passages 52. It should further be noted that in the FIG. 7 embodiment the segments 20 are biased inwardly by a plurality of linear springs 40', one for each of the segments 20, with each of the springs 40' acting against a floating ring 67.

In order to assure that the horizontal die 18 moves only upwardly and downwardly under the impetus of the shoulder 28 of the rod 26, there are provided a plurality of vertical guide rods 68, fastened to the lower die 12. The resting plate 32 then has a plurality of slots 70 formed, for example, on a plurality of tabs 72 which engage with the rods 68, thus preventing the resting plate 32 from rotating relative to the housing 12. This helps to assure proper alignment of the conduit 50 and the passage 52.

Each of the segments 20 has on an exterior surface 74 thereof a plurality of ridges 76 aligned to fit against for example, the non-teeth portion of a gear which is serving as the workpiece 44. In this manner the quenching fluid as it passes through the out-facing holes 54 is directed particularly onto the teeth of a gear workpiece 44 leading to the necessary quench hardening thereof.

Figure 2:
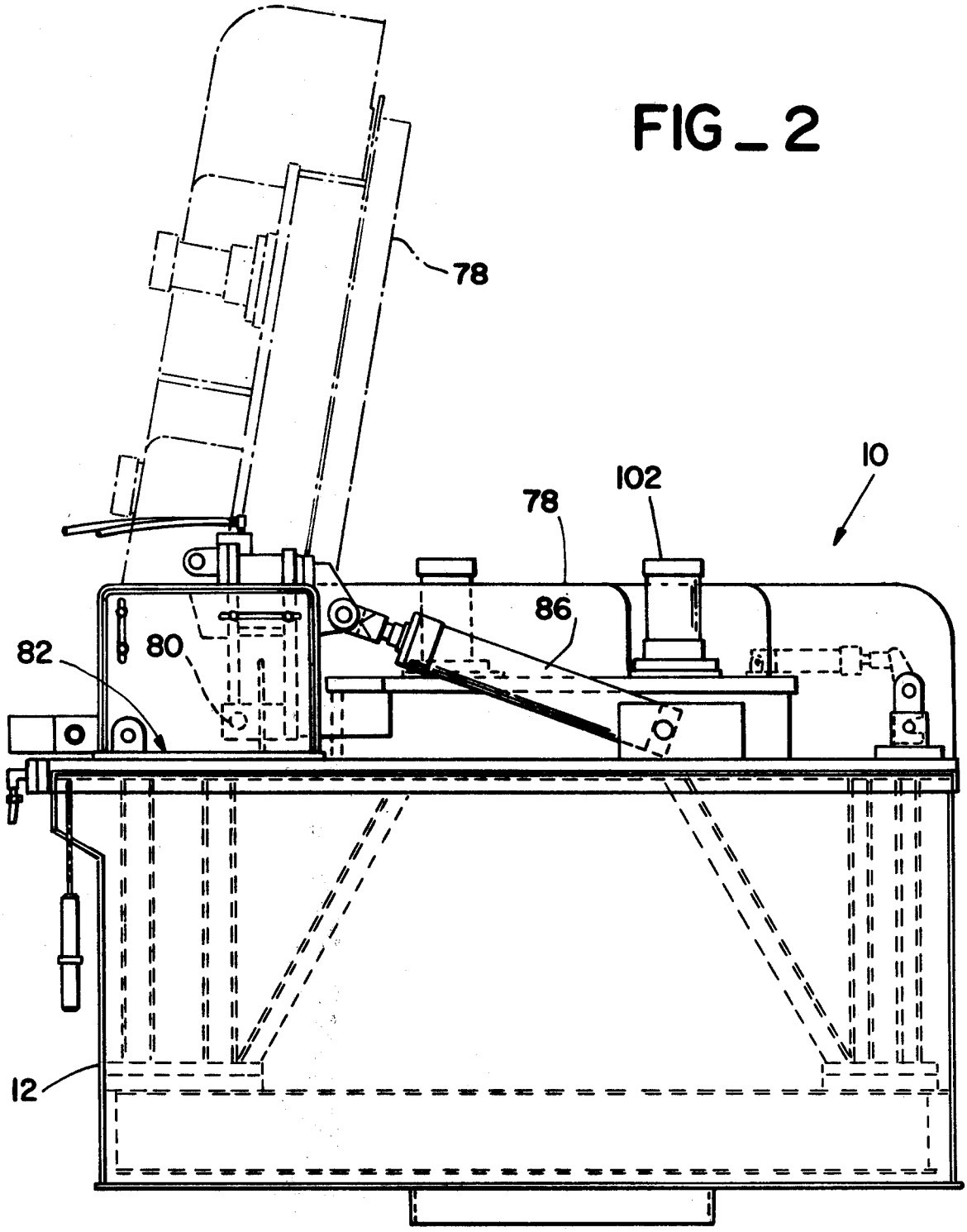
FIG. 2 illustrates, in side view, a press in accordance with the present invention with the upper platen thereof shown in phantom in its generally vertical position.
Figure 3:
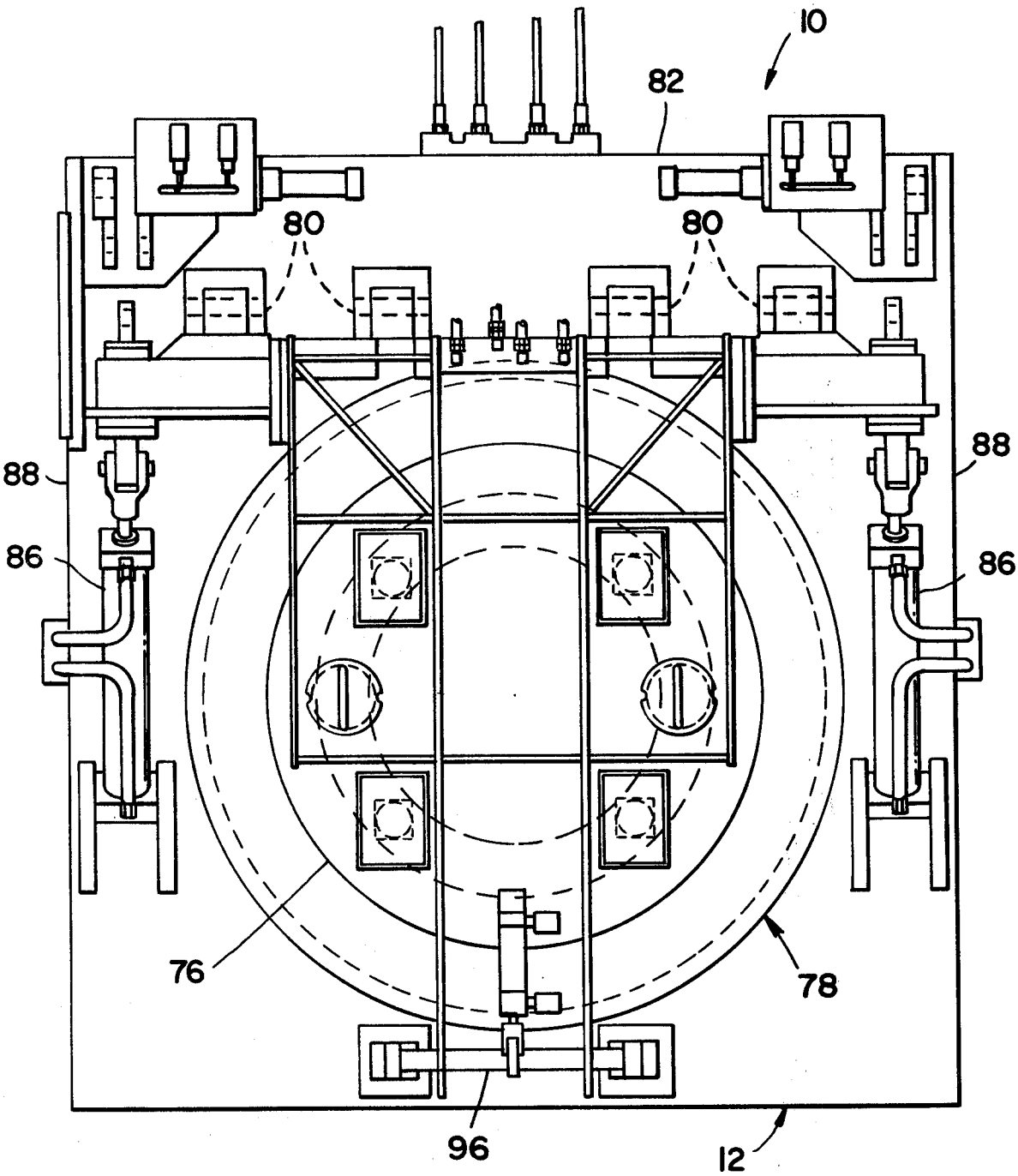
FIG. 3 illustrates, in top view, a press in accordance with the present invention.
Figure 4:
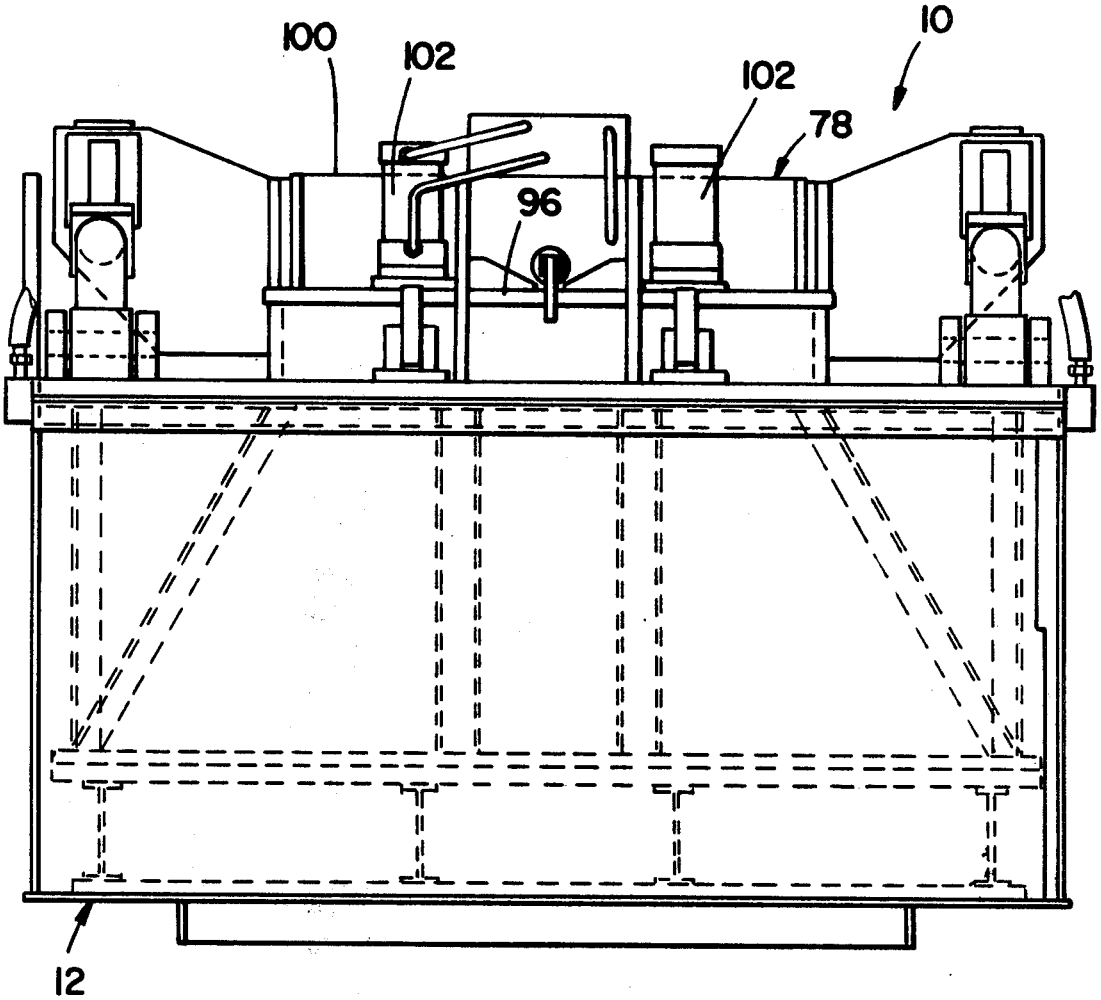
FIG. 4 illustrates, in front view, a press in accordance with the present invention.

By reference to FIGS. 2, 3 and 4 it will be seen that the press 10 includes an upper die 78 along with means for pivotally affixing the upper die to the frame 14. In the embodiment illustrated, the pivotal affixing of the upper die 78 to the frame 14 simply comprises a plurality of pins 80 adjacent one side 82 of the upper die 78. Means must also be provided for motivating the upper die 78 to pivot about the pins 80 into a horizontal position adjacent the horizontal die 18 and lower plate or die 22 to define therewith a quench zone 84. The motivating means must also serve to motivate the upper die 78 to pivot into a generally vertical position away from the horizontal die 18 for loading and unloading the workpiece 44. In the embodiment illustrated, the motivating means comprises a pair of hydraulic motors 86 which contract to motivate the upper die 78 into a horizontal position adjacent the horizontal die 18 and the lower die 12 and which expand to motivate the upper die 78 into a generally vertical position away from the horizontal die 18 and the lower die 12. Basically then, each of the hydraulic motors 86 acts between the frame 14, the lower die 12 and the upper die 78. The hydraulic motors 86 are located adjacent a pair of parallel sides 88 of the upper die 78.

Figure 5:
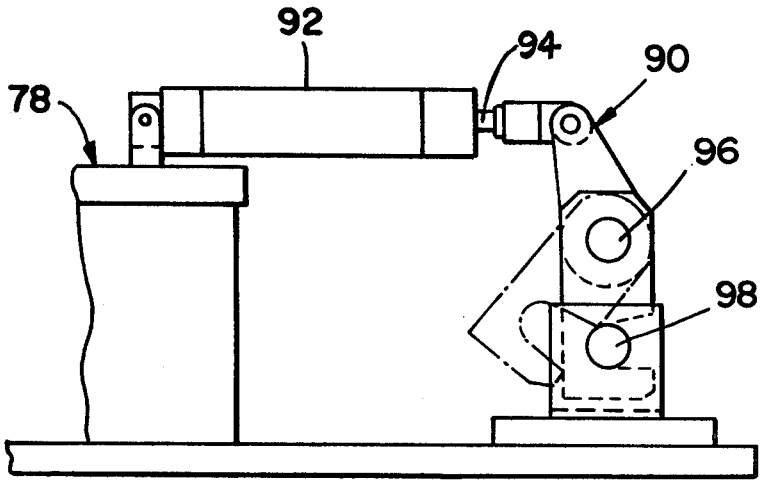
FIG. 5 illustrates, in enlarged view, a detail in a locking mechanism of a press in accordance with the present invention.

It is desirable that means be provided for locking the upper die 78 in its horizontal position. In the embodiment illustrated, this is accomplished via a latch mechanism 90 shown most clearly in FIG. 5. The latch mechanism 90 comprises a hydraulic latching motor 92 affixed at one end to the upper die 78 and engagable and disengagable on extension of a rod 94 thereof via a crossbar 96 with a pair of lock posts 98. Thus, the upper die 78 is locked in place relative to the horizontal die 18 and relative to the lower die 12.

Adverting to FIG. 1, the upper die 78 will generally include motor means, in the embodiment illustrated a plurality of hydraulic motors 102 which act downwardly from a frame structure 100 (when the upper die 78 is in its horizontal position adjacent the horizontal die 18), towards said horizontal die 18 and more particularly towards a workpiece 44 held by the horizontal die 18. A pressure ring 104 is carried by the hydraulic motors 102 and pressed downwardly thereby against the top of the workpiece 44. The pressure ring 104 seals against the top of the horizontal die 18 while leaving sufficient space for quench fluid to escape therearound.

It will be noted that while there are a great number of dimensional parameters which must be critically controlled in a conventional press, the press 10 as described above needs critical dimensional control only of the flatness of the flat support plate 22 and the perpendicularity of the hydraulic motor 24 and more particularly the rod 26 thereof relative to the flat support plate 22. This allows great simplicity of construction with concurrent cost savings since most parts do not require production with difficult to attain manufacturing tolerances. Further, it will be noted that the overall height of the press 10 can be relatively low whereby it can be used in low overhead areas and does not interfere with overhead crane equipment or the like. Further, since all tooling can be lifted into the press 10 from directly overhead, it is much easier to set up the press 10 for work with large gears and the like. Still further, because of the precise alignment of the horizontal die 18, the positioning of the workpiece 44 is easier to control. This results because of the vertical movement only (as a unit) of the horizontal die 18. For particular applications it is noted that the horizontal die 18 can be made totally stationary (although expandable).

Operation

The structure of the press 10 of the present invention will be better understood by considering it in operation. With the press 10 empty, the upper die 78 is rotated to its generally vertical position on expansion of the pair of hydraulic motors 86. The plurality of hydraulic motors 102 have their rods in the retracted position with the pressure ring 104 held thereby. The hydraulic motor 24 extends the rod 26 therefrom until the shoulder 28 of the rod 26 picks up the resting plate 32 along with the flat support plate 22 and the horizontal die 18 and raises the horizontal die 18 upwardly. The hot workpiece 44 is loaded over the horizontal die 18. The hydraulic motor 24 then retracts the rod 26 whereby the horizontal die 18 along with the flat support plate 22 and the resting plate 32 are lowered until the resting plate 32 rests upon the lower die 12. The upper die 78 is then rotated about the pair of pins 80 by retraction of the pair of hydraulic motors 86 until the upper die 78 is in a horizontal position adjacent the horizontal die 18. The latch mechanism 90 is then activated to lock the upper die 78 in place. The horizontal die 28 now is expanded to a predetermined position by means of hydraulic motor 24 which pulls down on cone 36 expanding segments 20. After a short delay, usually 2 to 3 seconds, the plurality of hydraulic motors 102 are energized to advance their rods whereby a clamping force is exerted downwardly from the pressure ring 204 upon the workpiece 44 and the horizontal die 18. Through conventional control mechanisms the actual force exerted by the plurality of hydraulic motors 102 can be adjusted to a desired value for the specific part being quenched. The quench fluid is now introduced at a controlled time and at controlled flow and pressure via the annular manifold 42 and either the conduit 50 or the conduit 56. At the end of the quenching operation, the press 10 is returned to the load position by releasing the latch mechanism 90 and expanding the pair of hydraulic motors 86 whereby the upper die 78 rotates to its generally vertical position away from the horizontal die 28 and the lower die 12.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. A lift top quench hardening press, comprising:
a frame;
a horizontal die supported by said frame;
a lower die supported by said frame;
means for controllably lifting said horizontal and lower dies;
an upper die supported by said frame;
means for moving said upper die between a generally horizontal position adjacent said lower and horizontal dies and defining a quench zone therewith and a position transversly spaced from said quench zone; and
means for delivering fluid to said quench zone.

2. A press as in claim 1, wherein said horizontal die comprises a plurality of segments and including means for moving said segments toward and from one another.

3. A press as in claim 1, including:
means for locking said upper die in said generally horizontal position.

4. A press as in claim 3, including a pressure ring and motor means for urging said pressure ring toward said horizontal die.

5. A press as in claim 1, wherein said lower die includes annular manifold means for controllably delivering a quench fluid to preselected locations in said quench zone.

6. A press as in claim 5, including fluid means for delivering quench fluid to different preselected locations in said quench zone.

7. A press as in claim 6, including means for blocking fluid communication between said manifold and said fluid means.

8. A press as in claim 6, including means for blocking fluid delivery from said manifold.

9. A press as in claim 1, wherein said upper die is pivoted between said positions.

10. A lift top quench hardening press, comprising:
a frame;
a horizontal die;
means on said frame for supporting said horizontal die;
means for lifting said horizontal die and said horizontal die support means;
a lower die;
means on said frame for supporting said lower die;
an upper die;
means for pivotally affixing said upper die to said frame;
means for motivating said upper die to pivot into a horizontal position adjacent said lower and horizontal dies to form therewith a quench chamber about a workpiece and into a generally vertical position away from said lower and horizontal dies for loading and unloading of said workpiece; and
means for delivering fluid to said chamber to quench harden said workpiece.

11. A press as in claim 10, wherein said workpiece is annular, said horizontal die is a circular die comprising a plurality of segments and said press includes frame supported means for moving said segments radially to expand and contract said horizontal die.

12. A press as in claim 10, including:
means for locking said upper die in said generally horizontal position.

13. A press as in claim 10, wherein said lower die includes annular manifold means for delivering a quench liquid simultaneously to an annular surface of said workpiece.

* * * * *

UNITED STATES PATENT AND TRADEMARK OFFICE

Certificate

Patent No. 4,143,863 Patented March 13, 1979

Kenneth D. Gladden

Application having been made by Kenneth D. Gladden, the inventor named in the patent above identified, and Caterpillar Tractor Co., Peoria, Ill., a corp. of California, the assignee, for the issuance of a certificate under the provisions of Title 35, Section 256, of the United States Code, adding the name of Samuel A. Campbell as a joint inventor, and a showing and proof of facts satisfying the requirements of the said section having been submitted, it is this 4th day of November 1980, certified that the name of the said Samuel A. Campbell is hereby added to the said patent as a joint inventor with the said Kenneth D. Gladden.

FRED W. SHERLING,
*Associate Solicitor.*